US012214983B2

(12) United States Patent
Kohara

(10) Patent No.: US 12,214,983 B2
(45) Date of Patent: Feb. 4, 2025

(54) SHEET STACKING DEVICE AND IMAGE FORMING SYSTEM

(71) Applicant: Satoshi Kohara, Tokyo (JP)

(72) Inventor: Satoshi Kohara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 18/150,101

(22) Filed: Jan. 4, 2023

(65) Prior Publication Data

US 2023/0234802 A1 Jul. 27, 2023

(30) Foreign Application Priority Data

Jan. 17, 2022 (JP) ..... 2022-005346

(51) Int. Cl.
*B65H 31/20* (2006.01)
*B65H 29/52* (2006.01)

(52) U.S. Cl.
CPC ..... *B65H 31/20* (2013.01); *B65H 29/52* (2013.01); *B65H 2401/11* (2013.01); *B65H 2401/20* (2013.01)

(58) Field of Classification Search
CPC ..... B65H 31/20; B65H 31/34; B65H 29/52; B65H 2401/11; B65H 2401/20; B65H 1/04; B65H 1/14; B65H 3/128; B65H 2511/12; B65H 2405/12; B65H 2405/115; B65H 2405/1116; B65H 2402/60
USPC ..... 270/58.27; 271/171, 226, 240, 248, 253
See application file for complete search history.

(56) References Cited

U.S. PATENT DOCUMENTS 8,210,525 B2 * 7/2012 Ushiyama ..... B65H 7/02 271/240
9,039,005 B2 * 5/2015 Minoshima ..... B65H 3/0684 271/9.08
10,494,207 B2 * 12/2019 Niikura ..... B65H 1/04

FOREIGN PATENT DOCUMENTS

| | | |
|---|---|---|
| JP | 2002-362756 | 12/2002 |
| JP | 2003-081448 | 3/2003 |
| JP | 2007-331916 | 12/2007 |
| JP | 2008-297075 | 12/2008 |
| JP | 2009-249175 | 10/2009 |

* cited by examiner

*Primary Examiner* — Leslie A Nicholson, III
(74) *Attorney, Agent, or Firm* — Harness, Dickey & Pierce, P.L.C.

(57) ABSTRACT

A sheet stacking device includes a sheet stacker, a pair of sheet restrictors, and a stacking adaptor. The sheet stacker has a first sheet stacking face on which a bundle of sheets is stacked. The sheet stacker includes a leading end support to support a leading end of the bundle of sheets in a feeding direction by a second sheet stacking face and a pair of cutouts disposed upstream from the leading end support. The pair of sheet restrictors slide in the pair of cutouts in a width direction orthogonal to the feeding direction to regulate a position of the bundle of sheets. The stacking adaptor is detachably attached to the sheet stacker to cover the pair of cutouts. The stacking adaptor has a third sheet stacking face to support a portion of the bundle of sheets disposed at the pair of cutouts.

11 Claims, 11 Drawing Sheets

SHEET STACKING DEVICE AND IMAGE FORMING SYSTEM

CROSS-REFERENCE TO RELATED APPLICATION

This patent application is based on and claims priority pursuant to 35 U.S.C. § 119 (a) to Japanese Patent Application No. 2022-005346, filed on Jan. 17, 2022, in the Japan Patent Office, the entire disclosure of which is hereby incorporated by reference herein.

BACKGROUND

Technical Field

Embodiments of the present disclosure relate to a sheet stacking device and an image forming system.

Related Art

A sheet stacking device is known in the art, which includes a sheet stacker on which sheets are stacked, and a pair of sheet restrictors supported by a bottom portion of the sheet stacking device. The pair of sheet restrictors slides in a width direction of the sheets to regulate a position of the sheets in the width direction on an upstream side in a feeding direction of the sheets with respect to a leading end of the sheets stacked on the sheet stacker in the feeding direction. The sheet stacker includes, for example, a leading end support that supports a leading end of the sheets in the feeding direction, and a cutout upstream from the leading end support in the feeding direction. The cutout is an opening of the sheet stacker in which the sheet restrictor slide.

SUMMARY

Embodiments of the present disclosure describe an improved sheet stacking device that includes a sheet stacker, a pair of sheet restrictors, and a stacking adaptor. The sheet stacker has a first sheet stacking face on which a bundle of sheets is stacked. The sheet stacker includes a leading end support to support a leading end of the bundle of sheets in a feeding direction of the bundle of sheets by a second sheet stacking face and a pair of cutouts disposed upstream from the leading end support. The pair of sheet restrictors slide in the pair of cutouts in a width direction orthogonal to the feeding direction to regulate a position of the bundle of sheets on the sheet stacker in the width direction. The stacking adaptor is detachably attached to the sheet stacker to cover the pair of cutouts. The stacking adaptor has a third sheet stacking face to support a portion of the bundle of sheets disposed at the pair of cutouts.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
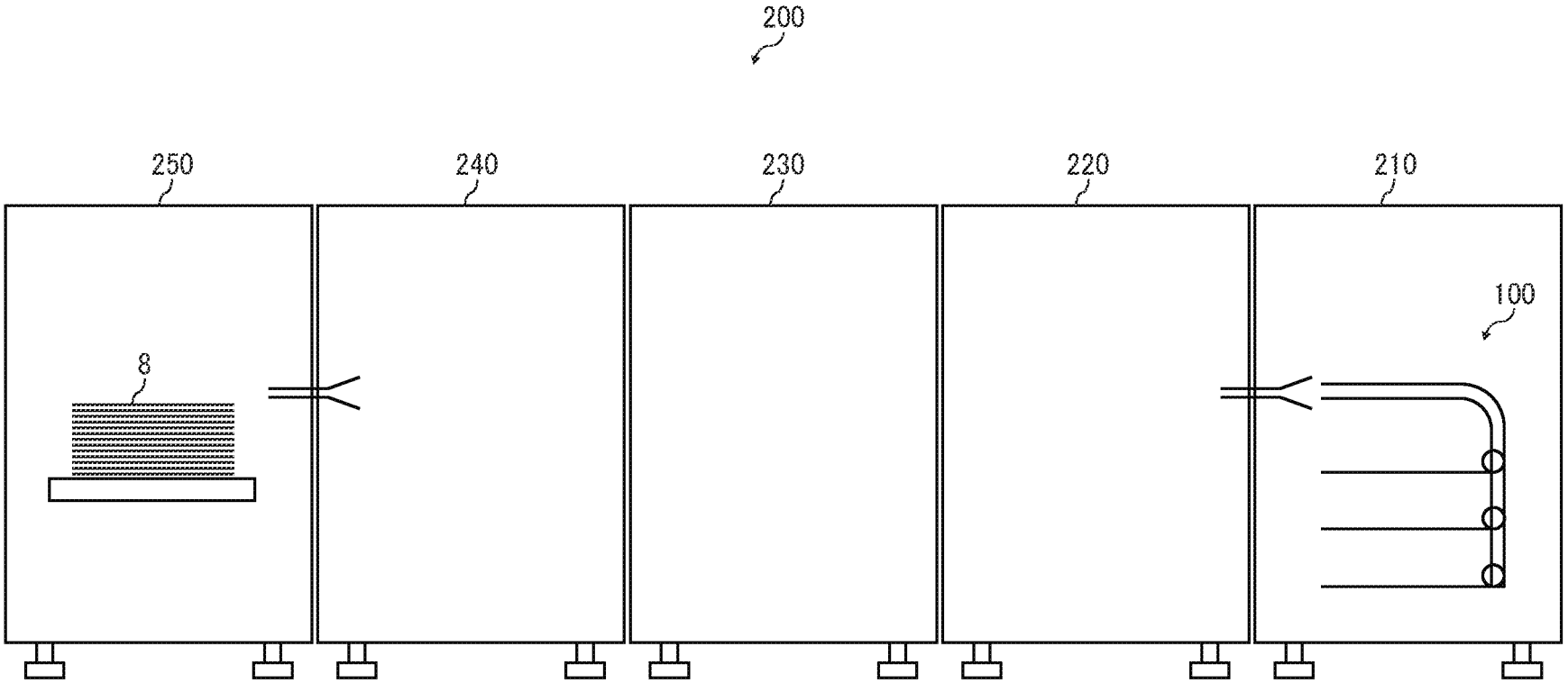
FIG. 1 is a schematic view of an image forming system according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below of an image forming system according to an embodiment of the present disclosure. In the present embodiment, the image forming system includes a sheet feeding device that is a sheet stacking device including a sheet feeder. FIG. 1 is a schematic view of an image forming system 200 according to the present embodiment. The image forming system 200 includes a sheet feeding device 210, a pretreatment liquid application device 220, an inkjet printer 230, a drying device 240, and a sheet output device 250.

The sheet feeding device 210 supplies a sheet 8 as a recording medium such as cut paper to the pretreatment liquid application device 220 disposed downstream from the sheet feeding device 210 in a conveyance path of the sheet 8. The pretreatment liquid application device 220 applies a pretreatment liquid to the sheet 8. The pretreatment liquid prevents blurring and bleed-through of inkjet ink for printing. The pretreatment liquid application device 220 includes a sheet reverse path to reverse the sheet 8. The pretreatment liquid is applied to a front side of the sheet 8. Thereafter, the sheet 8 is reversed in the sheet reverse path, and the pretreatment liquid is also applied to a back side of the sheet 8 in double-sided printing.

The inkjet printer 230 as an image forming device discharges ink droplets onto the front side of the sheet 8 to which the pretreatment liquid has been applied by the pretreatment liquid application device 220 to form a desired image. The drying device 240 includes a dryer that dries the image on the front side of the sheet 8 formed by the inkjet printer 230. In double-sided printing of the sheet 8, the sheet 8 is reversed in a path from the drying device 240 back to the inkjet printer 230. Then, the inkjet printer 230 discharges ink droplets to a front side (i.e., the back side before reversed) of the reversed sheet 8 to form a desired image, and the drying device 240 dries the image on the front side (i.e., the back side before reversed) of the sheet 8. Thereafter, the sheet 8 is ejected to the sheet output device 250.

Figure 2A:
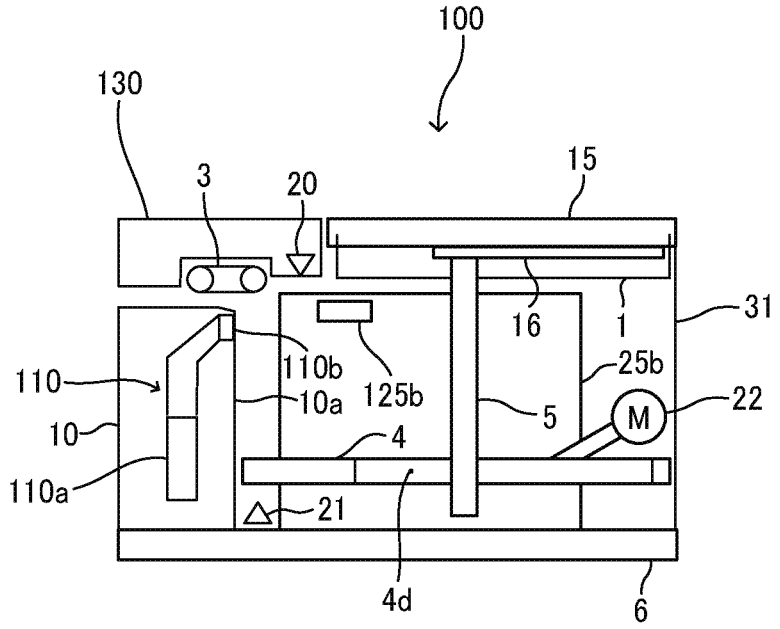
FIGS. 2A and 2B are schematic views of a sheet feeding tray of a sheet feeding device of the image forming system in FIG. 1.
Figure 2B:
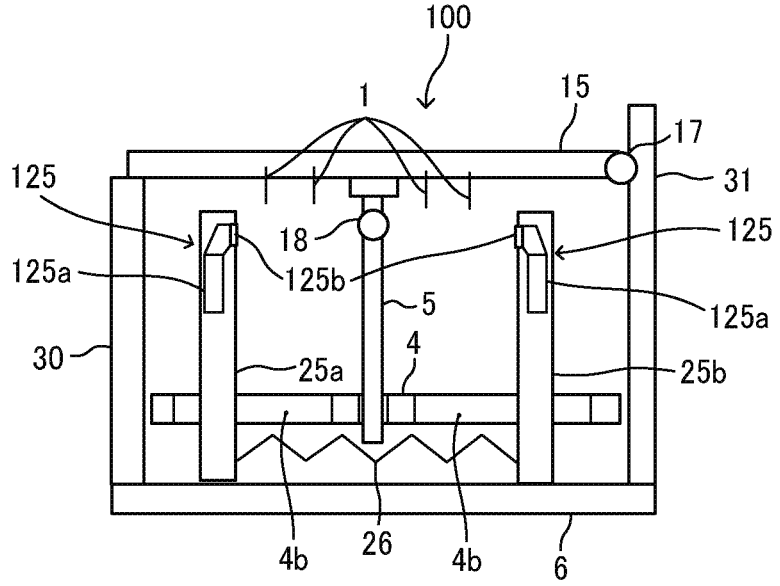

FIGS. 2A and 2B are schematic views of a sheet feeding tray 100 of the sheet feeding device 210. FIG. 2A is a front view of the sheet feeding tray 100, and the sheet 8 is fed from right to left in FIG. 2A. FIG. 2B is a right side view of the sheet feeding tray 100. The left-right direction in FIG. 2B is the front-back direction of the sheet feeding device 210 and a width direction of the sheet 8.

The sheet feeding tray 100 includes a bottom portion 6, a left housing 10 disposed on the downstream side in a feeding direction of the sheet 8, a front side plate 30 disposed on the front side of the sheet feeding device 210, a back side plate 31 disposed on the back side of the sheet feeding device 210. Thus, the sheet feeding tray 100 has a box shape in which an upper portion and a right side are open in FIG. 2A.

The sheet feeding tray 100 further includes a lift table 4 as a sheet stacker that moves up and down by a motor 22. The sheet feeding tray 100 further includes position sensors 20 and 21 disposed above and below a range where the lift table 4 is movable in the vertical direction, respectively. When the lift table 4 moves upward, the position sensor 20 detects the upper surface of the lift table 4, and the lift table 4 stops at a predetermined position based on the detection result of the position sensor 20. Similarly, when the lift table 4 moves downward, the position sensor 21 detects the lower surface of the lift table 4, and the lift table 4 stops at a predetermined position based on the detection result of the position sensor 21.

The sheet feeding tray 100 further includes an end fence 5 and two side fences 25*a* and 25*b*. The lift table 4 has an end fence cutout 4*d* through which the end fence 5 passes at the center in the width direction. The end fence cutout 4*d* is an opening elongated in the feeding direction. The lift table 4 further has two side fence cutouts 4*b* disposed at the center in the feeding direction and spaced apart at a predetermined interval in the width direction. The side fence 25*a* passes through the side fence cutout 4*b* on the front side of the sheet feeding device 210 (the left side in FIG. 2B), and the side fence 25*b* passes through the side fence cutout 4*b* on the back side of the sheet feeding device 210 (the right side in FIG. 2B).

The side fences 25*a* and 25*b* as a pair of sheet restrictors are disposed on both sides of the lift table 4 in the width direction of the sheet 8 (the front-back direction of the sheet feeding device 210), and the positions of the pair of side fences 25*a* and 25*b* are moved in accordance with the sheet 8 set on the lift table 4. The pair of side fences 25*a* and 25*b* are slidably supported by the bottom portion 6 and movable in opposite directions in the width direction of the sheet 8 in conjunction with each other by a connector 26 disposed above the bottom portion 6. Each of the side fences 25*a* and 25*b* regulates the position of a side end of the sheet 8 in the width direction.

A side blower device 125 is disposed in each of the side fences 25*a* and 25*b*. The side blower device 125 includes a side blower 125*a* and a side nozzle 125*b* disposed in an upper portion of each of the side fences 25*a* and 25*b*. The air taken in by the side blower 125*a* is blown from the side nozzle 125*b* onto a side face of an upper portion of a bundle of sheets 8 placed on the lift table 4.

An edge blower device 110 is disposed in the left housing 10. The edge blower device 110 includes an edge blower 110*a* and an edge nozzle 110*b* disposed in an upper portion of a left side plate 10*a* of the left housing 10. The air taken in by the edge blower 110*a* is blown from the edge nozzle 110*b* onto a leading end of the upper portion of the bundle of sheets 8 placed on the lift table 4. The upper sheet 8 of the bundle of sheets 8 is floated by the air blown from the edge nozzle 110*b* and the side nozzles 125*b*.

The end fence 5 is disposed at a position corresponding to a trailing end of the sheet 8. The end fence 5 serves as a trailing end restrictor that is movable to regulate the position of the trailing end of the sheet 8. The end fence 5 regulates the position of the trailing end of the sheet 8 while the leading end of the sheet 8 contacts the left side plate 10*a* of the left housing 10. The end fence 5 is held by a guide rail 16 serving as a stay disposed at an upper portion of the sheet feeding tray 100. The end fence 5 is movable along the guide rail 16 in a longitudinal direction of the guide rail 16 (i.e., the feeding direction).

The guide rail 16 is attached to a guide frame 15 having a frame shape that is along an edge of the box-shaped sheet feeding tray 100. Specifically, the guide rail 16 is attached to the center in the width direction of an upstream side support of the guide frame 15. The upstream side support extends in the width direction on the upstream side of the guide frame 15 in the feeding direction. The guide frame 15 is hinged on (swingably attached to) the back side plate 31 via a plurality of rotating hinges 17 which is rotatable. The end fence 5 moves along the guide rail 16 in the feeding direction and is secured at a desired position in the longitudinal direction of the guide rail 16. That is, the end fence 5 is secured at the desired position in response to various sizes of the sheet 8. The end fence 5 includes a rotating hinge 18, which is rotatable, therein.

A sheet pressing member 1 is attached to the guide frame 15 to hold down the sheet 8 floated by the air from the edge nozzle 110*b* and the side nozzles 125*b*. In the present embodiment, two sheet pressing members 1 are attached to the guide frame 15 at a predetermined interval on each of the front side and the back side with respect to the center in the width direction. The sheet pressing members 1 are detachably attached to the guide frame 15. The guide frame 15 has multiple attachment positions to which the sheet pressing member 1 is attached. The attachment position for the sheet pressing member 1 can be changed in response to the width of the sheet 8 placed on the lift table 4.

As the lift table 4 moves upward, the position sensor 20 detects that an uppermost sheet 8 of the bundle of sheets 8 stacked on the lift table 4 reaches a sheet feeding position, and the lift table 4 stops at the position in response to the detection of the position sensor 20. A plurality of pickup belts 3 is faces the downstream side portion of the lift table 4 in the feeding direction. The pickup belt 3 has a plurality of suction holes, and the uppermost sheet 8 floated by the air blown from the edge nozzle 110*b* and the side nozzles 125*b* is attracted onto the pickup belt 3 by a suction fan. Thus, when sheets 8 are stacked on the lift table 4, the sheets 8 are fed one by one in the feeding direction by the pickup belt 3. The pickup belt 3, the suction fan, and a driver of the pickup belt 3 construct a sheet feeder.

Figure 3:
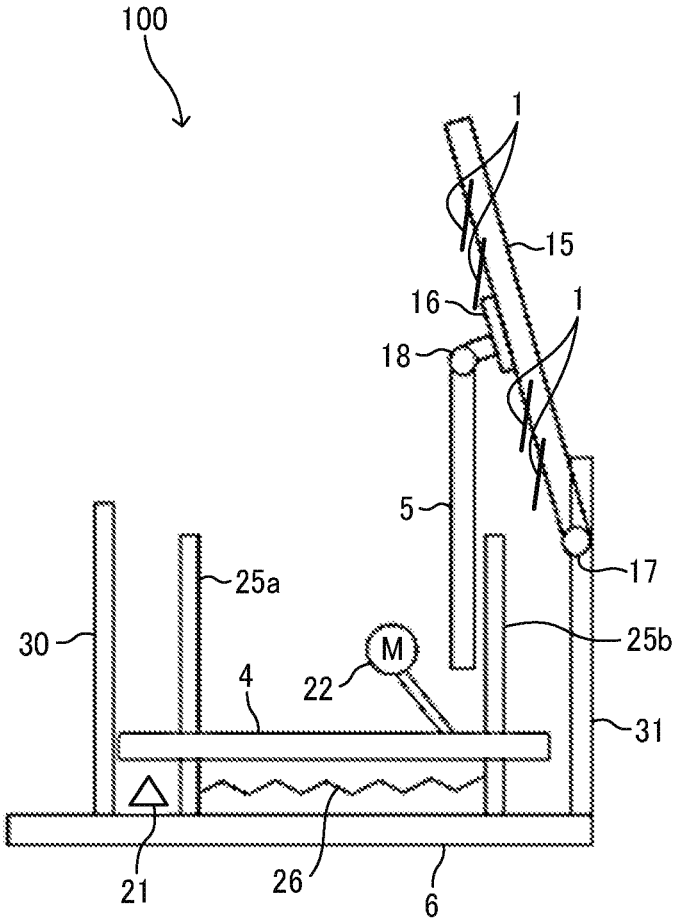
FIG. 3 is a schematic view of the sheet feeding tray, illustrating an example of movement of a guide frame and an end fence when a bundle of sheets is set in the sheet feeding tray.
Figure 4:
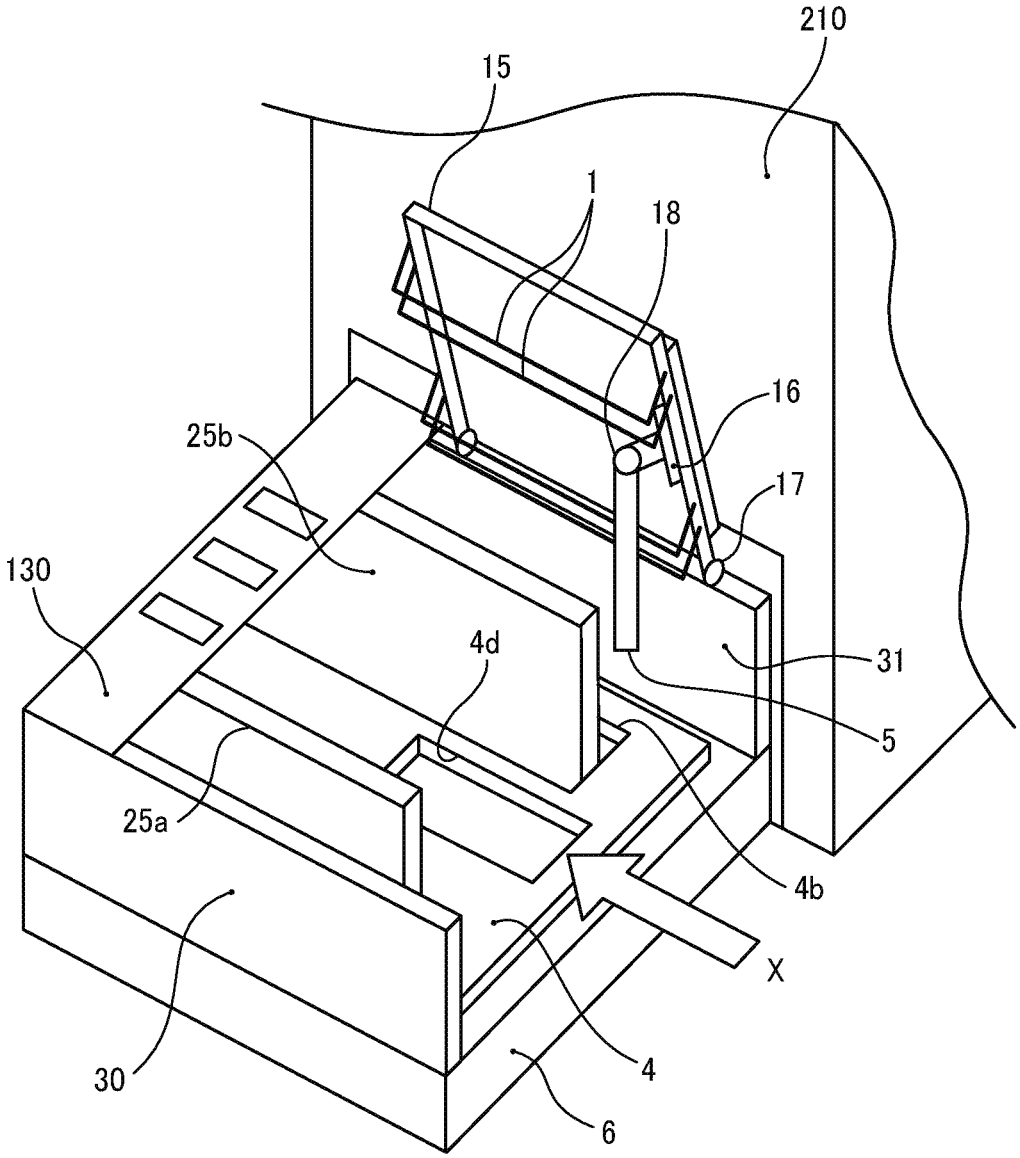
FIG. 4 is a perspective view of the sheet feeding tray that is pulled out from a device body of the sheet feeding device.

FIG. 3 is a schematic view of the sheet feeding tray 100, illustrating an example of movement of the guide frame 15 and the end fence 5 when the bundle of sheets 8 is set on the lift table 4. FIG. 4 is a perspective view of the sheet feeding tray 100 that is pulled out from the device body of the sheet feeding device 210.

When the sheet feeding device 210 detects that the sheet 8 runs out, the lift table 4 is lowered by the motor 22, the position sensor 21 detects the position of the lift table 4, and then the lift table 4 is stopped. The sheet feeding tray 100 is pulled out from the sheet feeding device 210, and the guide frame 15 is swung upward around the plurality of rotating hinges 17. At that time, the guide rail 16 secured to the guide frame 15 is also lifted together. The end fence 5 coupled to the guide rail 16 is moved and retracted in the vertical direction while being swung around the rotating hinge 18, so that the end fence 5 does not hinder the bundle of sheets 8 from being set on the lift table 4. The rotating hinge 17 applies torque to the guide frame 15 against only a direction in which the guide frame 15 is swung downward. Accordingly, when an operator sets the sheet 8 on the lift table 4, the guide frame 15 is not automatically swung downward even if the operator does not hold the guide frame 15 by hand.

The side fences 25*a* and 25*b* are moved in response to the width of the sheet 8 set on the lift table 4, and the guide frame 15 is swung downward around the rotating hinge 17, thereby changing the angle of the guide frame 15. The end fence 5 keeps a vertical posture around the rotating hinge 18 under gravity. Accordingly, when the guide frame 15 is swung downward, the end fence 5 returns to a predetermined position. Then, the end fence 5 and the side fences 25*a* and 25*b* are moved to suitable positions for the length and width of the sheet 8 set on the lift table 4.

As illustrated in FIGS. 2A, 2B, and 4, an upper housing 130 holding the sheet feeder and the position sensor 20 is disposed on the downstream side of the guide frame 15 in the feeding direction. An upstream end of the upper housing 130 in the feeding direction is disposed upstream from the left side plate 10*a* with which the leading end of the sheet 8 on the lift table 4 is brought into contact. Accordingly, the bundle of sheets 8 is placed near the center of the lift table 4 in the feeding direction and slid on the lift table 4 to the downstream side in the feeding direction as indicated by arrow X in FIG. 4, and the leading end of the bundle of sheets 8 is brought into contact with the left side plate 10*a* to set the bundle of sheets 8.

Figure 5A:
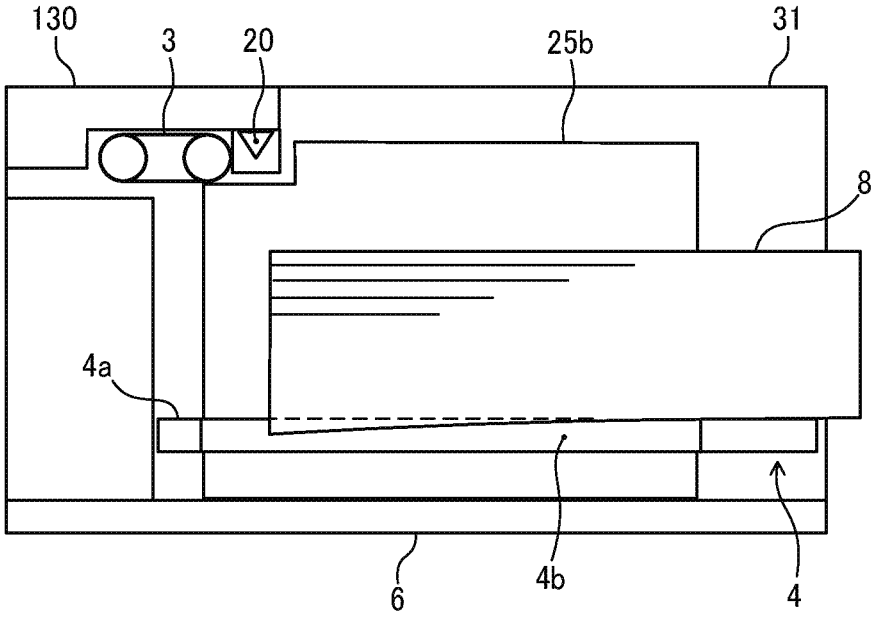
FIGS. 5A and 5B are schematic views of the sheet feeding tray in which the bundle of sheets is placed near the center of a lift table in the feeding direction.
Figure 5B:
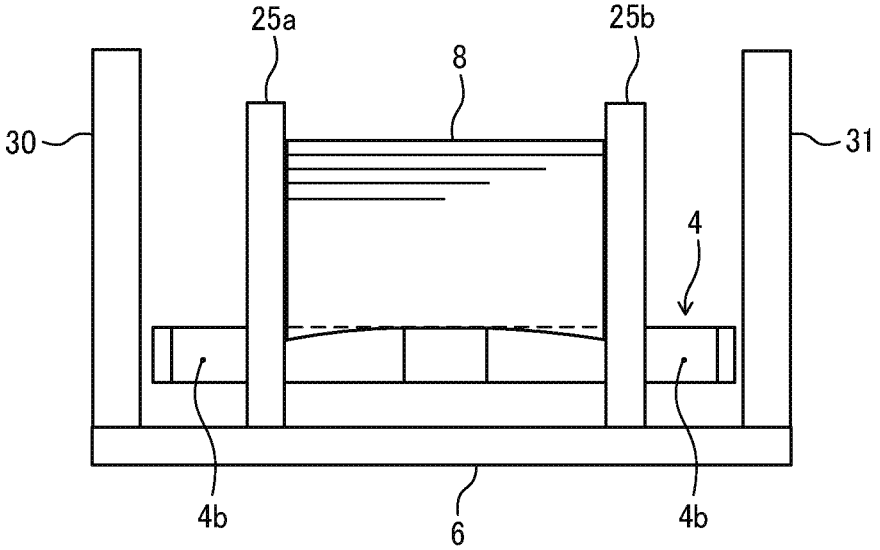

FIGS. 5A and 5B are schematic views of the sheet feeding tray 100 in which the bundle of sheets 8 is placed near the center of the lift table 4 in the feeding direction.

Center portions of the lift table 4 in the feeding direction are cut out to form two openings, that is, the pair of side fence cutouts 4*b*. Thus, the side fences 25*a* and 25*b* can slide in the pair of side fence cutouts 4*b* in the width direction to regulate the position of ends of the sheet 8 having the minimum usable width in the width direction. Accordingly, when the bundle of sheets 8 larger than the minimum usable width is placed near the center of the lift table 4 in the feeding direction, both sides of the leading end in the width direction of the lower sheet 8 of the bundle of sheets 8 (i.e., a leading widthwise ends of the sheet 8) sag down under gravity and enter the side fence cutout 4*b* as illustrated in FIGS. 5A and 5B. In such a state, if the bundle of sheets 8 on the lift table 4 is slid downstream in the feeding direction to bring the leading end of the sheet 8 into contact with the left side plate 10*a* of the left housing 10, the leading widthwise ends of the lower sheet 8 of the bundle of sheets 8 entering the side fence cutout 4*b* may bumps into a downstream edge of the side fence cutout 4*b* in the feeding direction. As a result, the leading end of the lower sheet 8 of the bundle of sheets 8 may be folded or torn.

Further, when the lower sheet 8 of the bundle of sheets 8 contacts the downstream edge of the side fence cutout 4*b* in the feeding direction, the bundle of sheets 8 is hindered from being slid downstream in the feeding direction. As a result, the bundle of sheets 8 may be set with a lower portion of the bundle of sheets 8 not in contact with the left side plate 10*a*. As described above, when the bundle of sheets 8 is set with the lower portion of the bundle of sheets 8 not in contact with the left side plate 10*a* (i.e., an improper stacking state that disturbs sheet feeding), the end fence 5 may not contact an upper trailing end of the bundle of sheets 8. As a result, the sheet 8 may be fed with the position of the trailing end being not regulated by the end fence 5, and the sheet 8 may move upstream in the feeding direction while being floated, resulting in unstable sheet feeding. Thus, the bundle of sheets 8 is required to be re-set on the lift table 4.

Therefore, in the present embodiment, a stacking adaptor 50 is attached to the lift table 4 in the side fence cutout 4*b* to support a portion of the bundle of sheets 8 facing the side fence cutout 4*b*. With reference to the drawings, embodiments of the present disclosure are described in detail below.

Figure 6:
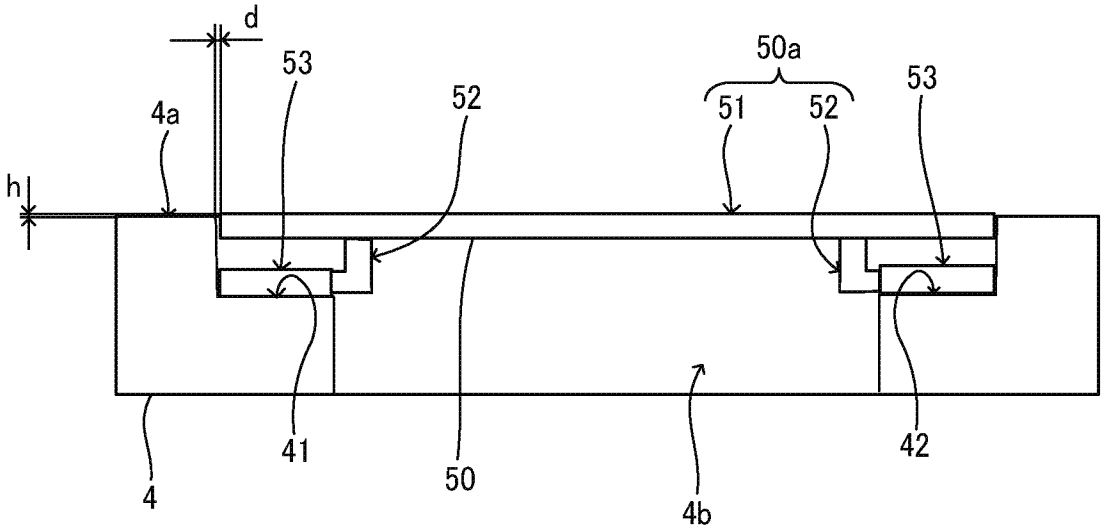
FIG. 6 is a schematic view of a stacking adaptor and the lifting table according to an embodiment of the present disclosure.
Figure 7A:
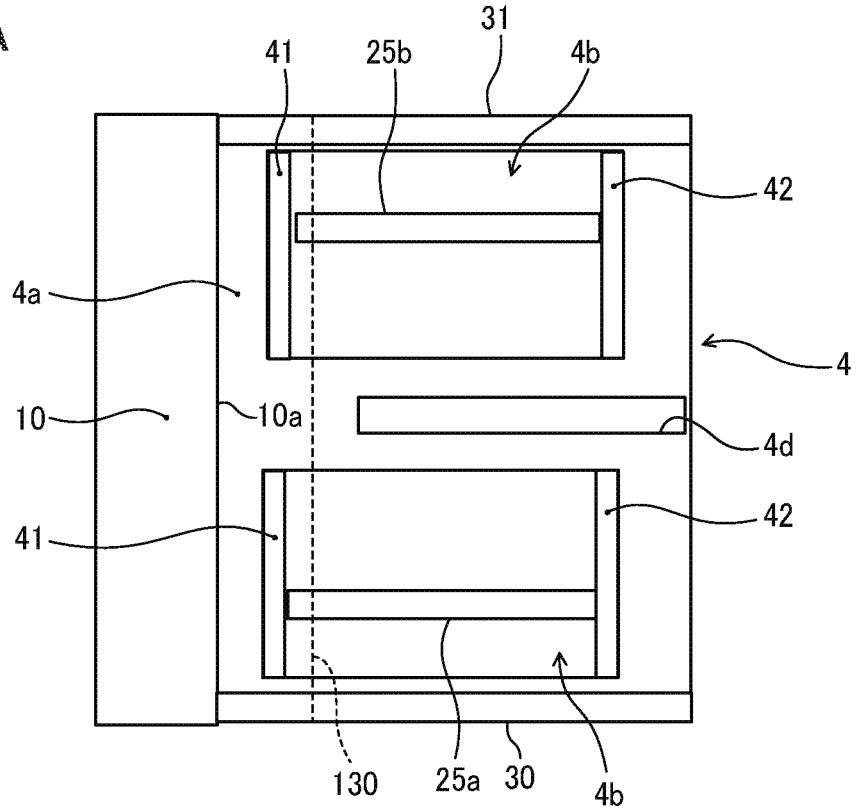
FIG. 7A is a schematic plan view of the sheet feeding tray before the stacking adaptor is attached.
Figure 7B:
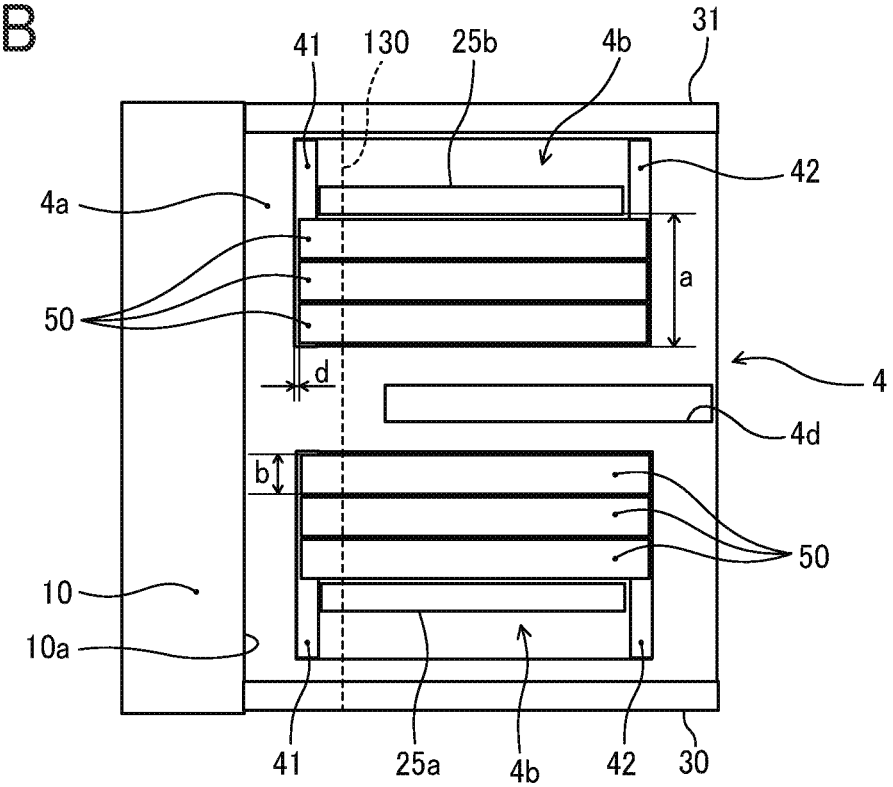
FIG. 7B is a schematic plan view of the sheet feeding tray to which the stacking adaptor has been attached.

FIG. 6 is a schematic view of the stacking adaptor 50 and the lift table 4. FIG. 7A is a schematic plan view of the sheet feeding tray 100 before the stacking adaptor 50 is attached. FIG. 7B is a schematic plan view of the sheet feeding tray 100 to which the stacking adaptor 50 has been attached.

As illustrated in FIG. 6 and FIGS. 7A and 7B, the sheet feeding tray 100 includes support portions 41 and 42 at both ends of the side fence cutout 4*b* in the feeding direction, respectively, to slidably support the stacking adaptor 50 in the width direction. The support portions 41 and 42 are located at a position lower than a surface of the lift table 4 that contacts the sheet 8 (i.e., a sheet stacking face). As a result, when the stacking adaptor 50 is supported by the support portions 41 and 42, a sheet stacking face of a sheet stacking portion 51 of the stacking adaptor 50 and the sheet stacking face of the lift table 4 are located at substantially the same height.

As illustrated in FIG. 7B, the stacking adaptor 50 is attached inside a sheet regulating position at which the side fences 25*a* and 25*b* regulate the position of the sheet 8 in the width direction in the side fence cutout 4*b*. The number of stacking adaptors 50 to be attached to the lift table 4 is changed in response to a length of the side fence cutout 4*b* inside the side fence 25*a* in the width direction (i.e., a widthwise length a). Specifically, when the widthwise length a is equal to or more than a transverse length b of the stacking adaptor 50 and less than twice the transverse length b (i.e., $b \le a < 2b$), one stacking adaptor 50 is attached to the lift table 4 in each side fence cutout 4*b*. When the widthwise length a is equal to or more than twice the transverse length b of the stacking adaptor 50 and less than three times the transverse length b (i.e., $2b \le a < 3b$), two stacking adaptors 50 are attached to the lift table 4 in each side fence cutout 4*b*.

When the widthwise length a is equal to an integer multiple of the transverse length b of the stacking adaptor 50, the stacking adaptor 50 can cover the side fence cutout 4*b* inside each of the side fences 25*a* and 25*b* with almost no clearance in the width direction. When the widthwise length a is not equal to an integer multiple of the transverse length b of the stacking adaptor 50, the stacking adaptor 50 does not cover the side fence cutout 4*b* without any clearance. At this time, the stacking adaptor 50 is slid in the width direction to adjust the position of the stacking adaptor 50 in the width direction. For example, the positions of the stacking adaptors 50 in the width direction are adjusted so that the clearances between the stacking adaptors 50 are substantially the same. Thus, the stacking adaptor 50 supports the bundle of sheets 8 to prevent the leading widthwise ends of the lower sheet 8 of the bundle of sheets 8 from sagging down under gravity.

Note that, when the transverse length b of the stacking adaptor 50 is long, the clearance on both sides of the stacking adaptor 50 in the width direction becomes large if the widthwise length a is slightly smaller than an integer multiple of the transverse length b. As a result, the stacking adaptor 50 may not sufficiently support a bundle of sheets having low stiffness such as a thin sheet, and the leading widthwise ends of the bundle of sheets may sag down under gravity. On the other hand, when the transverse length b of the stacking adaptor 50 is short, the clearance on both sides of the stacking adaptor 50 in the width direction can be small even if the widthwise length a is slightly smaller than an integer multiple of the transverse length b. However, the number of the stacking adaptors 50 attached to the lift table 4 may increase when the bundle of sheets having the maximum usable size in the width direction is set on the lift table 4, thereby increasing the work burden of an operator. Therefore, the transverse length b of the stacking adaptor 50 is set to a preferable length in consideration of influences when the bundle of sheets having low stiffness is set and when the bundle of sheets having the maximum usable size in the width direction is set.

Note that multiple stacking adaptors 50 having different transverse lengths may be provided, and the stacking adaptor 50 suitable for the widthwise length a of the side fence cutout 4*b* inside each of the side fences 25*a* and 25*b* may be attached to the lift table 4 in the side fence cutout 4*b*. As a result, regardless of the width of the sheet to be set, the stacking adaptor 50 can preferably cover the side fence cutout 4*b* inside each of the side fences 25*a* and 25*b* in the width direction. On the other hand, in the present embodiment, the multiple stacking adaptors 50 are attached to the lift table 4. As a result, the multiple stacking adaptors 50 having the same configuration (e.g., the same transverse length) can be used for various size of the sheet 8, thereby reducing the manufacturing cost of the sheet feeding device 210.

As illustrated in FIG. 6, the stacking adaptor 50 includes a body 50*a* including the sheet stacking portion 51 on which the sheet 8 is placed and a fixing portion 52, and a slider 53. The sliders 53 are secured to the fixing portions 52 disposed near both ends of the lower surface of the sheet stacking portion 51 in the feeding direction. Each fixing portion 52 projects downward from the lower surface of the sheet stacking portion 51 and bends at a right angle in the feeding direction. Specifically, the fixing portion 52 disposed near the downstream end of the sheet stacking portion 51 in the feeding direction bends at a right angle toward the downstream side in the feeding direction, and the fixing portion 52 disposed near the upstream end of the sheet stacking portion 51 in the feeding direction bends at a right angle toward the upstream side in the feeding direction. The slider 53 is attached to a distal end of each of the fixing portions 52. The sliders 53 secured to the fixing portions 52 are placed on the support portions 41 and 42, and thus the stacking adaptor 50 is supported by the lift table 4.

The body 50*a* including the sheet stacking portion 51 and the fixing portion 52 is made of metal, and the slider 53 is made of resins having slidability, such as polyacetal and nylon. Since a supported portion of the stacking adaptor 50 supported by each of the support portions 41 and 42 is the slider 53 made of resins having slidability, the stacking adaptor 50 can be smoothly slid in the width direction of the sheet 8, and the position of the stacking adaptor 50 in the width direction can be adjusted as desired.

The sheet stacking face of the sheet stacking portion 51 is set so as not to be lower (i.e., a height difference $h<0$) than at least a sheet stacking face of a leading end support 4*a* of the lift table 4. That is, the height of the sheet stacking face of the sheet stacking portion 51 is set to be equal to or higher (i.e., the height difference $h\geq 0$ as illustrated in FIG. 6) than the height of the sheet stacking face of the leading end support 4*a* of the lift table 4, thereby preventing the leading end of the lowermost sheet 8 of the bundle of sheets 8 from being caught by an upstream edge of the leading end support 4*a* in the feeding direction when the bundle of sheets 8 placed on the lift table 4 is slid downstream in the feeding direction to set the bundle of sheets 8 in the sheet feeding tray 100.

More preferably, the height of the sheet stacking face of the sheet stacking portion 51 is the same as the height of the sheet stacking face of the lift table 4 (i.e., the height difference $h=0$). When the height of the sheet stacking face of the sheet stacking portion 51 is set to the same as the height of the sheet stacking face of the lift table 4, the portion of the bundle of sheets 8 supported by the stacking adaptor 50 is not pushed up by the stacking adaptor 50. As a result, the bundle of sheets 8 can be stably stacked in the sheet feeding tray 100, and the sheet feeding device 210 can stably feed the sheet 8 from the bundle of sheets 8.

Further, a gap d between the leading end support 4*a* and the sheet stacking portion 51 is minimized to prevent the leading end of the lowermost sheet 8 of the bundle of sheets 8 from entering the gap when the bundle of sheets 8 is slid downstream in the feeding direction. Specifically, the gap d is set such that, when a sheet having low stiffness such as a thin sheet is placed on the lift table 4 and slid downstream in the feeding direction, and the leading end of the sheet passes through the gap d, the leading end of the sheet does not sag down and is not caught by the upstream edge of the leading end support 4*a* in the feeding direction. Accordingly, when the bundle of sheets 8 placed on the lift table 4 is slid downstream in the feeding direction, the leading end of the lowermost sheet 8 of the bundle of sheets 8 is not caught by the upstream edge of the leading end support 4*a* in the feeding direction, and thus the bundle of sheets 8 can be reliably set in the sheet feeding tray 100.

When the body 50*a* of the stacking adaptor 50 includes the supported portions supported by the support portions 41 and 42 of the lift table 4, and the stacking adaptor 50 is made of one material, the sheet stacking face of the sheet stacking portion 51 may be lower than the sheet stacking face of the leading end support 4*a* of the lift table 4 on which the leading end of the sheet 8 is placed due to manufacturing tolerances.

On the other hand, in the present embodiment, the slider 53 is made of another material different from the material of the body 50*a*, enabling to adjust the height difference h to 0 or more with the slider 53 attached to the body 50*a*. In addition, the body 50*a* can be supported by the support portions 41 and 42 at a position shifted downstream in the feeding direction with the slider 53 attached to each fixing portion 52. That is, the short slider 53 is attached to the fixing portion 52 on the downstream side in the feeding direction, thereby positioning the downstream end of the short slider 53 upstream from the leading end of the sheet stacking portion 51 in the feeding direction. On the other hand, the long slider 53, which is longer than the short slider 53, is attached to the fixing portion 52 on the upstream side in the feeding direction, thereby positioning the upstream end of the long slider 53 upstream from the tailing end of the sheet stacking portion 51 in the feeding direction. As a result, the body 50*a* of the stacking adaptor 50 can be shifted downstream in the feeding direction when supported by the support portions 41 and 42. Thus, the gap d between the sheet stacking portion 51 and the leading end support 4*a* can be minimized by the slider 53 to be attached.

Figure 8A:
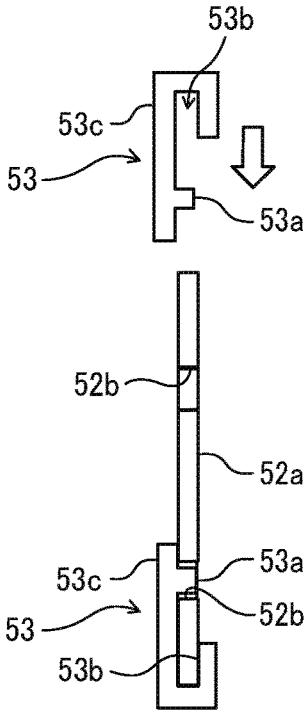
FIGS. 8A to 8C are schematic views of a slider secured to a fixing portion of the stacking adaptor as one example.
Figure 8B:
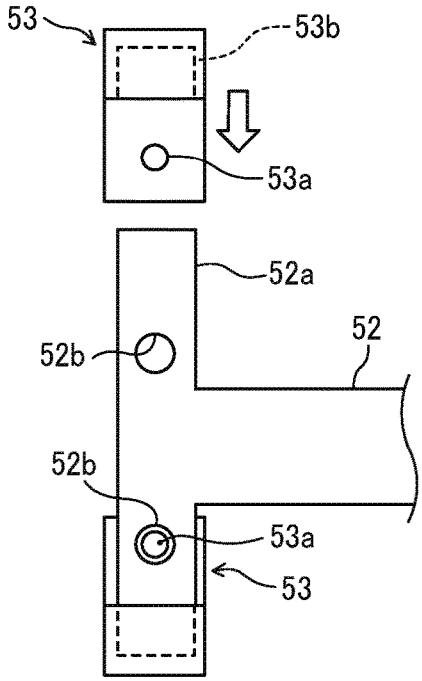
Figure 8C:
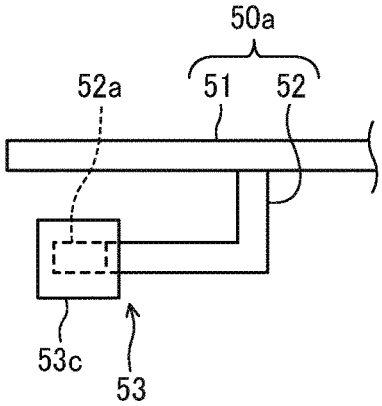

FIGS. 8A to 8C are schematic views of the slider 53 secured to the fixing portion 52 as one example. FIG. 8A is a schematic view of the fixing portion 52 and the slider 53 as viewed in the feeding direction. FIG. 8B is a schematic view of the fixing portion 52 and the slider 53 as viewed from above. FIG. 8C is a schematic view of the fixing portion 52 and the slider 53 as viewed in the width direction. Although FIGS. 8A to 8C illustrate the fixing portion 52 on the downstream side in the feeding direction, the fixing portion 52 on the upstream side in the feeding direction has the same configuration.

A distal portion 52*a* of the fixing portion 52 illustrated in FIG. 8B extends to one side and the other side in the width direction, and the slider 53 is attached to each end of the distal portion 52*a* in the width direction. The distal portion 52*a* of the fixing portion 52 has two through holes 52*b* at a predetermined interval in the width direction, and the slider 53 has a projection 53*a* that fits into the through hole 52*b*.

The slider 53 includes a groove 53*b*, the projection 53*a*, and a sliding portion 53*c*. A lower face of the sliding portion 53*c* slides against the support portion 41 (see FIG. 7B). The projection 53*a* is disposed on an upper face of the sliding portion 53*c*, and the groove 53*b* is disposed at one end of the sliding portion 53*c* and recessed in the width direction. The end of the distal portion 52*a* of the fixing portion 52 in the width direction fits into the groove 53*b*.

When the slider 53 is moved in a direction indicated by the blank arrow in FIGS. 8A and 8B to fit the end of the distal portion 52*a* in the width direction into the groove 53*b* of the slider 53, the sliding portion 53*c* of the slider 53 is elastically deformed and the projection 53*a* climbs up on the distal portion 52*a*. As the slider 53 is further moved in the direction indicated by the blank arrow in FIGS. 8A and 8B, the distal portion 52*a* is inserted into the groove 53*b*, and the end of the distal portion 52*a* in the width direction contacts the bottom of the groove 53*b*, and at the same time, the projection 53*a* enters the through hole 52*b* of the distal portion 52*a*. Thus, the slider 53 is attached to the fixing portion 52 by snap-fit. Since the slider 53 is snap-fitted to the fixing portion 52, the slider 53 can be easily replaced, thereby easily adjusting the height difference h.

Figure 9A:
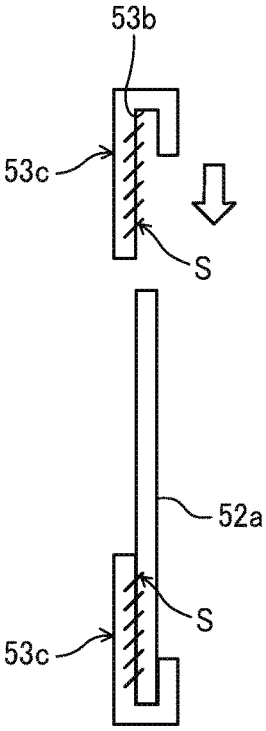
FIGS. 9A and 9B are schematic views of the slider secured to the fixing portion as another example.
Figure 9B:
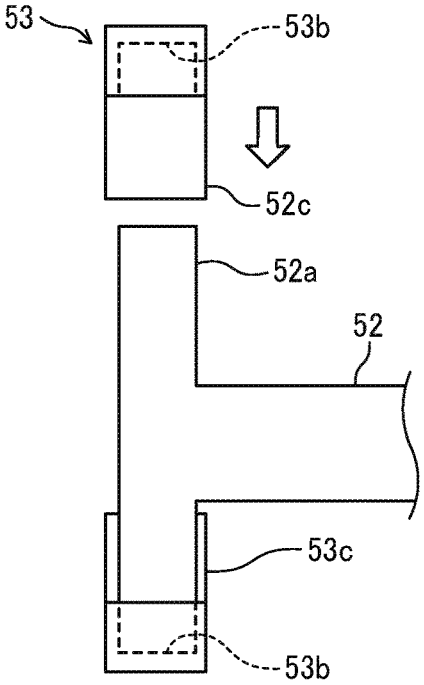

FIGS. 9A to 9B are schematic views of the slider 53 secured to the fixing portion 52 as another example. In FIGS. 9A and 9B, the slider 53 is secured to the fixing portion 52 with an adhesive S. Specifically, the adhesive S is applied to the upper surface of the sliding portion 53*c*, and the sliding portion 53*c* is bonded and secured to the distal portion 52*a* of the fixing portion 52. As described above, since the slider 53 is bonded and secured to the fixing portion 52 of the body 50*a* with the adhesive S, the slider 53 and the fixing portion 52 have a simple configuration as compared to when the slider 53 is snap-fitted. The method of securing the slider 53 to the fixing portion 52 is not limited to the above examples, and various known methods such as a double-sided tape can be employed.

Figure 10A:
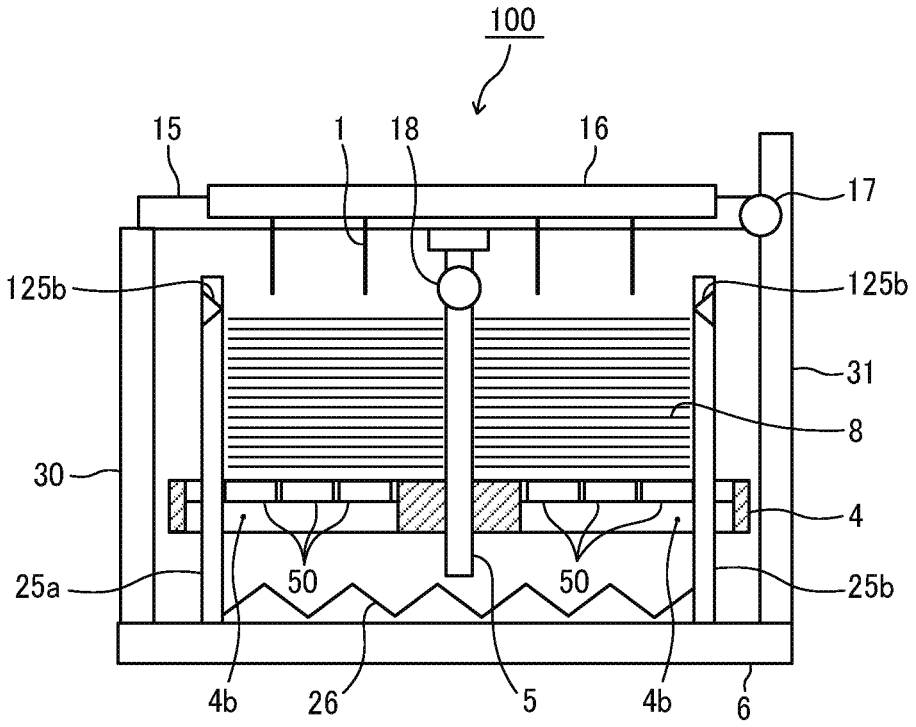
FIG. 10A is a schematic view of the sheet feeding tray in which a bundle of wide sheets is set.
Figure 10B:
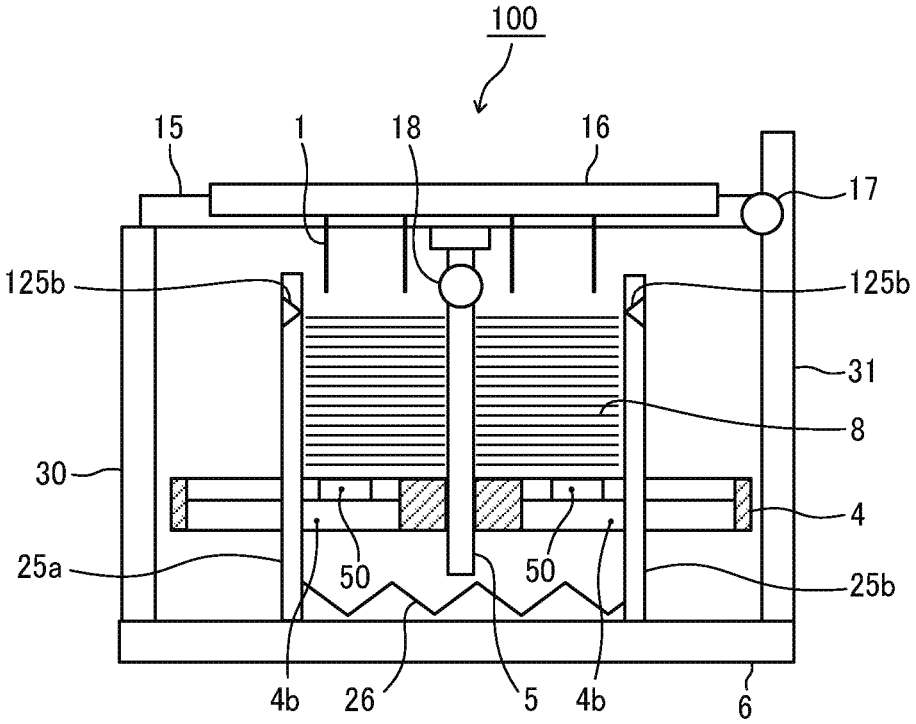
FIG. 10B is a schematic view of the sheet feeding tray in which a bundle of narrow sheets is set.

FIG. 10A is a schematic view of the sheet feeding tray 100 in which a bundle of wide sheets 8 is set, and FIG. 10B is a schematic view of the sheet feeding tray 100 in which the bundle of narrow sheets 8 is set. As illustrated in FIG. 10A, when the bundle of wide sheets 8 is set, three stacking adaptors 50 are attached in each side fence cutout 4*b*. Then, the stacking adaptors 50 are slid in the width direction to adjust the positions of the stacking adaptors 50 with the uniform clearance therebetween in the width direction.

On the other hand, as illustrated in FIG. 10B, when the bundle of narrow sheets 8 is set, one stacking adaptor 50 is attached in each side fence cutout 4*b*. Then, the stacking adaptor 50 is slid in the width direction to adjust the position of the stacking adaptor 50 with the uniform clearance on both sides thereof in the width direction.

When the bundle of wide sheets 8 is set as illustrated in FIG. 10A, the sheet pressing member 1 is shifted outward in the width direction as compared to when the bundle of narrow sheets 8 is set as illustrated in FIG. 10B. As described above, since the sheet pressing member 1 is shifted to a preferable position corresponding to the width of the sheet 8, the sheet pressing member 1 can maintain the posture of the floated uppermost sheet 8 even when the sheet of any width is used.

Figure 11A:
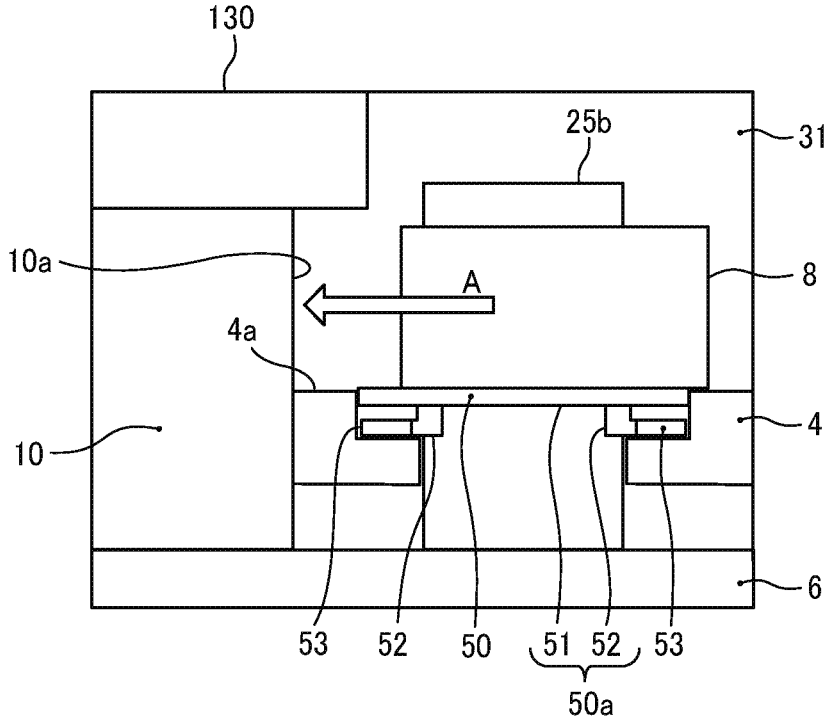
FIGS. 11A and 11B are schematic views of the sheet feeding tray according to the present embodiment when the bundle of sheets is set in the sheet feeding tray.
Figure 11B:
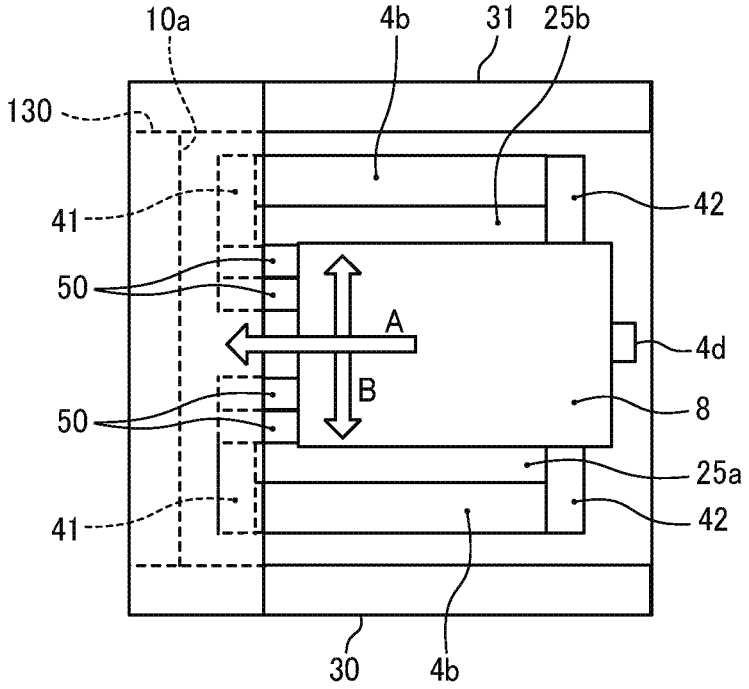

FIGS. 11A and 11B are schematic views of the sheet feeding tray 100 according to the present embodiment when the bundle of sheets 8 is set in the sheet feeding tray 100. In preparation, the side fences 25*a* and 25*b* are slid to positions corresponding to the width of the sheet 8 to be set in the direction indicated by arrow B in FIG. 11B. Next, the suitable number of stacking adaptors 50 corresponding to the widthwise length of a portion of the side fence cutout 4*b* inside each of the side fences 25*a* and 25*b* in the width direction are attached to the lift table 4. Then, the stacking adaptors 50 are slid in the width direction to adjust the position of the stacking adaptors 50 in the width direction.

Next, as described above, the bundle of sheets 8 is placed near the center of the lift table 4 in the feeding direction, and the bundle of sheets 8 is slid downstream in the feeding direction indicated by arrow A in FIGS. 11A and 11B so as to bring the leading end of the sheet 8 into contact with the left side plate 10*a*.

In the present embodiment, the stacking adaptor 50 supports a portion of the bundle of sheets 8 facing the side fence cutout 4*b*. As a result, the leading widthwise ends of the lower portion of the bundle of sheets 8 does not sag down under gravity. Further, in the present embodiment, the height of the sheet stacking face of the sheet stacking portion 51 of the stacking adaptor 50 is equal to or higher than the height of the sheet stacking face of the leading end support 4*a* of the lift table 4. Accordingly, the leading widthwise ends of the lower portion of the bundle of sheets 8 is not caught by the upstream edge of the leading end support 4*a* of the lift table 4 in the feeding direction, and thus the bundle of sheets 8 can be slid in the feeding direction so that the leading end of the bundle of sheets 8 contacts the leading end support 4*a*. As a result, the leading end of the lower sheet 8 of the bundle of sheets 8 is not folded or torn, and the leading end of the bundle of sheets 8 can be brought into contact with the left side plate 10*a*.

Further, the lower sheet 8 of the bundle of sheets 8 is not hindered from being slid in the direction indicated by arrow A in FIGS. 11A and 11B, and all the sheets 8 of the bundle of sheets 8 can be brought into contact with the left side plate 10*a*, thereby preventing the improper stacking state that disturbs sheet feeding. As a result, the end fence 5 reliably contacts the entire trailing end of the bundle of sheets 8, and the sheet 8 does not move upstream in the feeding direction while being floated, resulting in stable sheet feeding. Since the stacking state does not disturb sheet feeding, re-setting of the bundle of sheets 8 is unnecessary.

Further, in the present embodiment, the gap d between the downstream end of the stacking adaptor 50 and the upstream edge of the leading end support 4*a* in the feeding direction is minimized. Thus, when the bundle of sheets 8 is slid upstream in the feeding direction, the leading end of the lowermost sheet 8 of the bundle of sheets 8 does not enter the gap d. As a result, the lower sheet 8 of the bundle of sheets 8 is reliably prevented from being folded or torn.

Figure 12A:
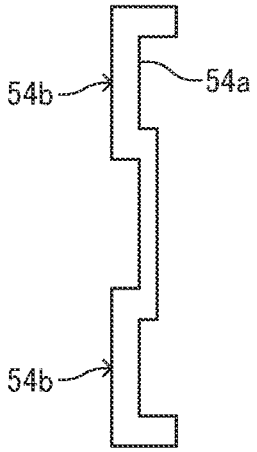
FIGS. 12A to 12C are schematic views of the stacking adaptor made of resin having slidability.
Figure 12B:
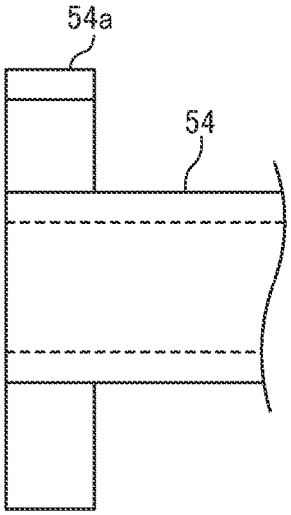
Figure 12C:
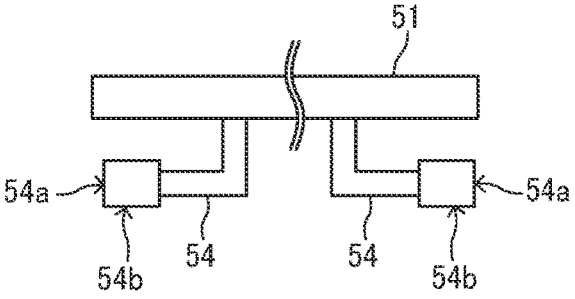

In another embodiment, the stacking adaptor 50 may be made of resin having slidability (e.g., a slidable resin such as polyacetal and nylon) and may be formed as a single-piece body. FIGS. 12A to 12C are schematic views of the stacking adaptor 50 made of resin having slidability.

The stacking adaptor 50 illustrated in FIGS. 12A to 12C includes a supported portion 54 having substantially the same shape as the fixing portion 52 of the stacking adaptor 50 according to the above-described embodiment. The supported portion 54 has a sliding surface 54*b* that slides against the support portion 41 (or 42) of the lift table 4 on a distal portion 54*a* of the supported portion 54. Thus, the stacking adaptor 50 made of resin having slidability does not have a separated slider such as the slider 53, thereby reducing the number of components to construct the sheet feeding device 210.

The embodiments described above are just examples, and the various aspects of the present disclosure attain respective effects as follows.

Aspect 1

A sheet stacking device such as the sheet feeding device 210 includes a sheet stacker such as the lift table 4, a pair of sheet restrictors such as the pair of side fences 25*a* and 25*b*, and a stacking adaptor such as the stacking adaptor 50. The sheet stacker has a first sheet stacking face on which a bundle of sheets is stacked. The sheet stacker includes a leading end support such as the leading end support 4*a* to support a leading end of the bundle of sheets in a feeding direction of the bundle of sheets by a second sheet stacking face and a pair of cutouts such as the pair of side fence cutouts 4*b* disposed upstream from the leading end support. The pair of sheet restrictors slide in the pair of cutouts in a width direction orthogonal to the feeding direction to regulate a position of the bundle of sheets on the sheet stacker in the width direction. The stacking adaptor is detachably attached to the sheet stacker to cover the pair of cutouts. The stacking adaptor has a third sheet stacking face to support a portion of the bundle of sheets disposed at the pair of cutouts.

When the bundle of sheets is set from the upstream side in the feeding direction of the sheet feeding device, the bundle of sheets is placed near the center of the sheet stacker such as the lift table 4 in the feeding direction, and then slid downstream on the sheet stacker in the feeding direction so that the leading end of the bundle of sheets contacts the left side plate 10*a* on the downstream side in the feeding direction, thereby setting the bundle of sheets in the sheet feeding device. When the bundle of sheets is placed near the center of the sheet stacker in the feeding direction, if both the leading widthwise ends of the bundle of sheets face the cutout such as the side fence cutout 4*b*, the leading widthwise ends of the lower sheet of the bundle of sheets may sag down under gravity and enter the cutout (see FIGS. 5A and 5B). When both the leading widthwise ends of the lower sheet of the bundle of sheets enter the cutout, if the bundle of sheets is slid downstream in the feeding direction, the leading widthwise ends of the lower sheet of the bundle of sheets may be caught by the downstream edge of the cutout in the feeding direction, and the lower sheet of the bundle of sheets may be folded or torn.

On the other hand, in Aspect 1, the stacking adaptor 50 attached in the cutout supports the portion, which faces the cutout, of the bundle of sheets stacked on the sheet stacker. As a result, when the bundle of sheets is placed near the center of the sheet stacker in the feeding direction, both the leading widthwise ends of the lower sheet of the bundle of sheets are supported by the stacking adaptor 50 and prevented from sagging down under gravity. With this configuration, when the bundle of sheets on the sheet stacker is slid downstream in the feeding direction, both the leading widthwise ends of the lower sheet of the bundle of sheets are prevented from being caught by the downstream edge of the cutout in the feeding direction, and from being folded or torn.

Further, since the stacking adaptor 50 is detachably attached to the sheet stacker in the cutout, the stacking adaptor 50 to be attached in the cutout can be easily replaced in response to the width of the bundle of sheets set on the sheet stacker.

Aspect 2

In Aspect 1, the height of the sheet stacking face of the stacking adaptor 50 (i.e., the third sheet stacking face) is equal to or higher than the sheet stacking face of the leading end support 4*a* (i.e., the second sheet stacking face).

With this configuration, as described in the above embodiment, when the bundle of sheets is placed near the center of the sheet stacker such as the lift table 4 in the feeding direction and slid downstream in the feeding direction, the portion of the lowermost sheet of the bundle of sheets supported by the stacking adaptor 50 is not caught by the upstream edge of the leading end support 4*a* in the feeding direction. As a result, the lower sheet of the bundle of sheets is prevented from being folded or torn.

Aspect 3

In Aspect 2, the sheet stacking face of the stacking adaptor 50 (i.e., the third sheet stacking face) is at the same height as the sheet stacking face of the sheet stacker such as the lift table 4 (i.e., the first sheet stacking face).

With this configuration, the portion of the bundle of sheets supported by the stacking adaptor 50 is not pushed up by the stacking adaptor 50. As a result, the bundle of sheets can be stably stacked in the sheet stacking device, and the sheet stacking device can stably feed the sheet from the bundle of sheets.

Aspect 4

In any one of Aspects 1 to 3, the sheet stacking device further includes a slider configured to adjust a gap d between a downstream end of the stacking adaptor 50 and the leading end support 4*a* in the feeding direction.

With this configuration, when the bundle of sheets stacked on the sheet stacker is slid downstream in the feeding direction, the leading end of the lowermost sheet of the bundle of sheets is prevented from entering the gap d between the downstream end of the stacking adaptor 50 and the leading end support 4*a* and from being caught by the leading end support 4*a*. As a result, the lower sheet of the bundle of sheets is prevented from being folded or torn.

Aspect 5

In any one of Aspects 1 to 4, the stacking adaptor 50 is slidable in the width direction to cover the pair of cutouts such as the pair of side fence cutouts 4*b*.

With this configuration, as described in the above embodiment, the position of the stacking adaptor 50 is adjustable in the width direction. Even if the stacking adaptor 50 does not completely cover the portion of the cutout such as the side fence cutout 4*b* inside the sheet restrictor such as the side fences 25*a* and 25*b* in the width direction, the stacking adaptor 50 can sufficiently support the lower sheet of the bundle of sheets so that the lower sheet of the bundle of sheets does not sag down.

Aspect 6

In Aspect 5, the sheet stacker further includes a support portion such as the support portions 41 and 42 configured to support the stacking adaptor 50 in the pair of cutouts such as the side fence cutouts 4*b*, and the stacking adaptor 50 includes a body such as the body 50*a* having the third sheet stacking face and a slider such as the slider 53 slidably contacting the support portion.

With this configuration, as described in the above embodiment, the stacking adaptor 50 can be smoothly slid on the support portions 41 and 42 in the width direction to adjust the position of the stacking adaptor 50 in the width direction as desired.

In addition, since the slider is a separated component from the body, the height of the sheet stacking face of the stacking adaptor 50 and the gap d between the stacking adaptor 50 and the leading end support 4*a* can be adjusted by the slider attached to the body 50*a*.

Aspect 7

In Aspect 6, the slider 53 is snap-fitted to the body 50*a*.

With this configuration, the slider 53 can be easily attached to and detached from the body 50*a* of the stacking adaptor 50.

Aspect 8

In Aspect 6, the slider 53 is bonded to the body 50*a*.

With this configuration, the slider 53 can be secured to the body 50*a* with a simple configuration as compared to when the slider 53 is snap-fitted.

Aspect 9

In Aspect 5, the stacking adaptor is made of a slidable resin.

With this configuration, as described with reference to FIGS. 12A to 12C, the stacking adaptor can be formed as a single-piece body without the separated slider, thereby reducing the number of components to construct the sheet stacking device.

Aspect 10

In any one of Aspects 1 to 9, the stacking adaptor 50 includes multiple stacking adaptors 50 attachable to the sheet stacker to cover the pair of cutouts such as the side fence cutouts 4*b*.

With this configuration, as described in the above embodiment, the number of the stacking adaptors 50 attached to the sheet stacker in the cutout can be changed in response to the width of the bundle of sheets stacked on the sheet stacker such as the lift table 4. As a result, when the bundle of wide sheets is stacked on the sheet stacker, the number of the stacking adaptors 50 attached in the cutout is increased to allow the stacking adaptors 50 to sufficiently support the bundle of wide sheets. On the other hand, when the bundle of narrow sheets is stacked on the sheet stacker, the number of the stacking adaptors 50 attached in the cutout is decreased to allow the sheet restrictor such as the side fences 25*a* and 25*b* to contact the side face of the bundle of sheets Aspect 11

An image forming system includes an image forming device to form an image on a sheet and the sheet stacking device according to any one of Aspects 1 to 10 to feed the sheet from the bundle of sheets to the image forming device.

With this configuration, the sheet stacked on the sheet stacker can be fed to the image forming device to form an image on the sheet.

As described above, according to the present disclosure, the lower sheet of the bundle of sheets is prevented from being folded or torn.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A sheet stacking device comprising:

a sheet stacker having a first sheet stacking face on which a bundle of sheets is stacked, the sheet stacker including:

a leading end support configured to support a leading end of the bundle of sheets in a feeding direction of the bundle of sheets by a second sheet stacking face; and a pair of cutouts upstream from the leading end support in the feeding direction; and a pair of sheet restrictors configured to slide in the pair of cutouts in a width direction orthogonal to the feeding direction to regulate a position of the bundle of sheets on the sheet stacker in the width direction; and a stacking adaptor detachably attached to the sheet stacker to cover the pair of cutouts, the stacking adaptor having a third sheet stacking face to support a portion of the bundle of sheets disposed at the pair of cutouts.

2. The sheet stacking device according to claim 1, wherein a height of the third sheet stacking face is equal to or higher than a height of the second sheet stacking face.

3. The sheet stacking device according to claim 2, wherein the third sheet stacking face is at the same height as the first sheet stacking face.

4. The sheet stacking device according claim 1, further comprising a slider configured to adjust a gap between a downstream end of the stacking adaptor and the leading end support in the feeding direction.

5. The sheet stacking device according to claim 1, wherein the stacking adaptor is slidable in the width direction to cover the pair of cutouts.

6. The sheet stacking device according to claim 5, wherein the sheet stacker further includes a support portion configured to support the stacking adaptor in the pair of cutouts, and the stacking adaptor includes:

a body having the third sheet stacking face; and a slider slidably contacting the support portion.

7. The sheet stacking device according to claim 6, wherein the slider is snap-fitted to the body.

8. The sheet stacking device according to claim 6, wherein the slider is bonded to the body.

9. The sheet stacking device according to claim 5, wherein the stacking adaptor is made of a slidable resin.

10. The sheet stacking device according to claim 1, wherein the stacking adaptor includes multiple stacking adaptors attachable to the sheet stacker to cover the pair of cutouts.

11. An image forming system comprising:

an image forming device configured to form an image on a sheet; and the sheet stacking device according to claim 1 to feed the sheet from the bundle of sheets to the image forming device.

* * * * *